US005417553A

United States Patent [19]

Gibson et al.

[11] Patent Number: 5,417,553

[45] Date of Patent: May 23, 1995

[54] SUBMERSIBLE PUMP SUPPORT

[76] Inventors: Roger L. Gibson, 27 Mason Dr., Salem, N.H. 03079; Steven L. Frasure, 9 Colonial Dr., Londonderry, N.H. 03053

[21] Appl. No.: 71,195

[22] Filed: Jun. 2, 1993

[51] Int. Cl.[6] ..... F04B 39/06

[52] U.S. Cl. ..... 417/366; 417/423.14; 417/423.3

[58] Field of Search ..... 417/423.3, 423.8, 423.9, 417/423.14, 366, 61; 248/676, 146, 84, 85, 86, 87, 88; D23/214, 216

[56] References Cited

U.S. PATENT DOCUMENTS

| | | | |
|---|---|---|---|
| 575,700 | 1/1897 | Charbonneau | 248/84 |
| 1,494,900 | 2/1923 | Blaw | 248/84 |
| 1,920,371 | 8/1933 | Franke | 103/87 |
| 2,620,232 | 12/1952 | King | 248/83 |
| 2,932,457 | 4/1960 | Ballard | D23/216 |
| 3,115,305 | 12/1963 | Riwkewich | D23/216 |
| 3,273,507 | 9/1966 | Handford | 103/87 |
| 3,397,647 | 8/1968 | Daniel | 103/218 |
| 3,470,822 | 10/1969 | Evans et al. | 103/35 |
| 3,612,721 | 10/1971 | Evans et al. | 417/61 |
| 3,736,075 | 6/1973 | Otto | 417/423.9 |
| 4,406,434 | 9/1983 | Schneckloth | 248/83 |
| 4,553,902 | 11/1985 | Eberhardt | 417/34 |
| 4,566,866 | 1/1986 | Kemmner | 417/366 |
| 5,219,277 | 6/1993 | Huckey | 417/366 |

*Primary Examiner*—Richard A. Bertsch
*Assistant Examiner*—Peter Korytnyk
*Attorney, Agent, or Firm*—Wolf, Greenfield & Sacks

[57] ABSTRACT

A submersible pump support including at least one pump housing, a first pump support rail extending in a first plane coupled to and supporting the at least one pump housing, a second pump support rail extending in the first direction in the first plane coupled to and supporting the at least one pump housing, wherein a distance of the at least one pump housing from the first plane is no more than one half a distance, in the first plane, between the first and second pump support rails. According to a another aspect of the invention, there is provided a submersible pump support including an intake screen located in the at least one pump housing so as to provide fluid flow over a pump assembly mounted in the at least one pump housing to an intake port of a pump in the pump assembly, the intake screen being located in the at least one pump housing and having a fluid flow capacity sufficient to provide a minimum fluid flow velocity determined by a cooling requirement of a pump assembly, the intake screen additionally having a fluid flow capacity sufficient to provide a maximum fluid flow velocity to reduce vortices in a fluid flowing through the at least one pump housing. The submersible pump support is constructed of a material having a specific gravity of less than one. In a preferred embodiment, the material is polyethylene (HDPE).

19 Claims, 5 Drawing Sheets

SUBMERSIBLE PUMP SUPPORT

BACKGROUND OF THE INVENTION

1. Field of the Invention

The present invention relates generally to submersible pump supports or "sleds," as they are known to those skilled in the art, that are submerged in a fluid, which fluid is typically water. More particularly, the present invention relates to a submersible pump support constructed out of a lighter than water material that becomes heavier than water upon the installation of a pump therein, thus reducing the weight of the pump support to enhance installation and retrieval of the pump support from a body of fluid.

2. Discussion of the Related Art

Until recently, only two basic types of pump supports were available. The first, a floating pump support, being more buoyant than a fluid, is designed to allow a pump to float on the surface of a body of fluid to be pumped.

The second type is a submersible pump support having a submersible pump installed therein that is typically submerged in a body of water such as a lake, pond, stream, or river for general purpose irrigation or water supply.

This second type of pump support is a heavier than water type sled, usually constructed of steel, that is designed to remain on the bottom of a body of water by virtue of its heavy weight. Although this type of pump support performs this function well, the heavy weight of the pump support typically requires heavy equipment for installation. Additionally, the weight of the pump support makes it difficult to easily retrieve the pump support and pump from the bottom of a body of water because the heavy pump support tends to sink into the mud or debris at the bottom of a body water.

There has recently become available a submersible pump support constructed out of high-density polyethylene (HDPE). This pump support is lighter than water and floats when no pump has been installed therein. However, when a pump assembly is installed in the pump support, it becomes heavier than water and sinks to the bottom of the body of water. Since the pump support is lighter than water, during removal of the pump support from a body of water, effectively it is only the weight of the pump really needs to be moved, since the pump support itself is lighter than water. This greatly eases installation and removal of the submersible pump support.

Although that pump support provides several advantages, it does have several drawbacks. First, due to the fact that it is constructed out of a lighter than water material, it has a tendency to tip over due to the torque generated when the pump assembly is turned on. In addition, the location and size of the intake port may not, under operating conditions where the water of a high enough temperature, for example, higher than approximately 70° F., provide a sufficient volume of water over the pump assembly to provide adequate cooling of the pump assembly.

Therefore, an object of the present invention is to provide a lighter than water submersible pump support that is stable and does not tip over during operation of the pump.

Another object of the present invention is to provide a lighter than water submersible pump support having an intake screen sized and located in the pump support to provide adequate fluid flow over a pump assembly installed in the pump housing.

SUMMARY OF THE INVENTION

The disadvantages of the prior art are overcome by the present invention which provides a submersible pump support including at least one pump housing, a first pump support rail extending in a first plane coupled to and supporting the at least one pump housing, a second pump support rail extending in the first direction in the first plane coupled to and supporting the at least one pump housing, wherein a distance of the at least one pump housing from the first plane is no more than one half a distance, in the first plane, between the first and second pump support rails.

The submersible pump support is constructed of a material having a specific gravity of less than one. In a preferred embodiment, the material is polyethylene (HDPE). The polyethylene may include carbon black to protect the pump support from degradation due to ultraviolet rays. According to a another aspect of the invention, there is provided a submersible pump support including at least one pump housing, a first pump support rail extending in first direction in a first plane coupled to and supporting the at least one pump housing, a second pump support rail extending in a first direction in the first plane coupled to and supporting the at least one pump housing, and an intake screen located in the at least one pump housing so as to provide fluid flow over a pump assembly mounted in the at least one pump housing to an intake port of a pump in the pump assembly, the intake screen being located in the at least one pump housing and having a fluid flow capacity sufficient to provide a minimum fluid flow velocity determined by a cooling requirement of a pump assembly, the intake screen additionally having a fluid flow capacity sufficient to provide a maximum fluid flow velocity to reduce vortices in a fluid flowing through the at least one pump housing.

A third pump support rail extending in the first direction in a second plane, coupled to and supporting the at least one pump housing, wherein the second pump support rail additionally extends in the first direction in the second plane may be added to provide a vertical submersible pump support.

Multiple pump housings may be provided to construct duplex and triplex submersible pump supports. The elements of the submersible pump support may be coupled together by heat welds of polyethylene (HDPE).

The features and advantages of the present invention will be more readily understood and apparent from the following detailed description of the invention, which should be read in conjunction with the accompanying drawings and from the claims which are appended at the end of the detailed description.

BRIEF DESCRIPTION OF THE DRAWINGS

In the drawings, which are incorporated herein by reference and in which like elements have been given like reference characters.

DETAILED DESCRIPTION

For purposes of illustration only, and not to limit generality, the present invention will now be explained with reference to its use in a water pumping application. However, it is to be appreciated that the present invention is also useful in other applications, such as sewerage pumping, waste water pumping, leachate pumping, and so on. As used within this application, the term "fluid" is meant to refer to any such liquid medium in which the present invention may be submerged.

Figure 1B:
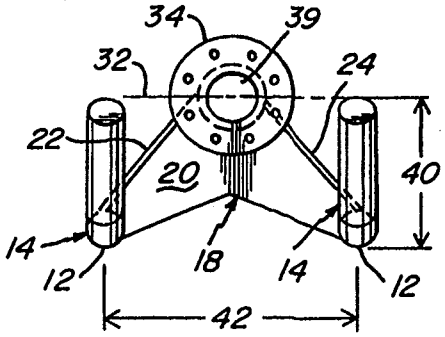
FIGS. 1, 1A, and 1B are respective elevation, plan, and cross-sectional (along line A—A of FIG. 1) views of one embodiment of the submersible pump support according to the present invention.
Figure 1:
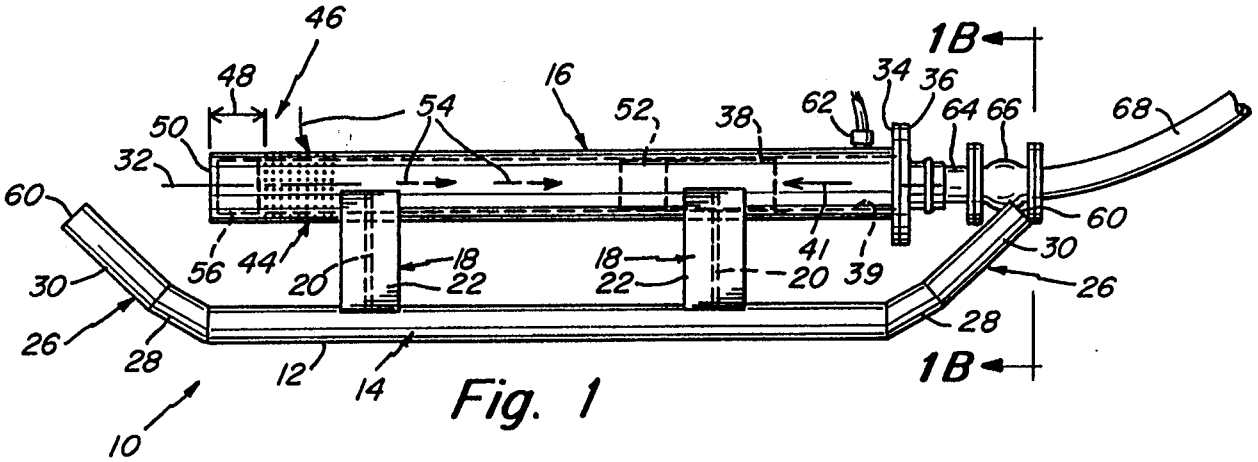
Figure 1A:
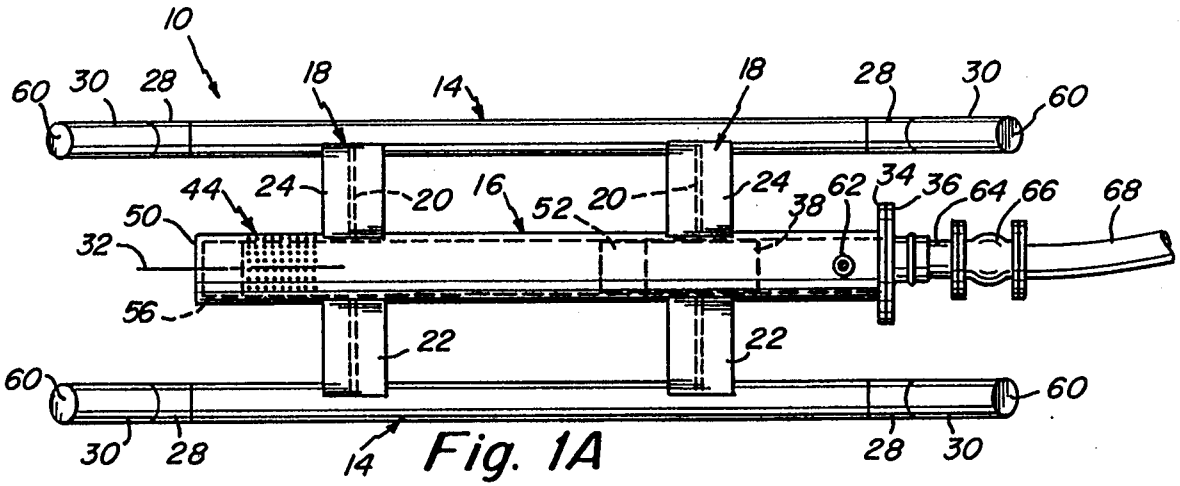

FIGS. 1, 1A, and 1B illustrate a first embodiment of a "horizontal" submersible pump support 10 in accordance with the present invention. The pump support is referred to as horizontal because it is meant to rest on the bottom of a body of fluid, such as water on surfaces 12 of pump support rails.

The submersible pump support includes a pump housing 16 attached to pump support rails 14 by cradles 18. Each cradle includes a web 20 and two plates 22 and 24. Pump housing 16, in a preferred embodiment, is a hollow tube.

Pump support rails 14 include angled portions 26. Angled portions 26 prevent the ends of pump support rails 14 from digging into the mud or debris at the bottom of a body of water to provide for easy removal of the pump support from the body of water. Angled portions 26 may include, in a preferred embodiment, two angled portions 28, 30, which provide a smoother curve to angled portion 26. Portion 30 is extended to end at approximately the center line 32 of pump housing 16.

Pump housing 16 includes a barrel flange 34 to which is mounted a split discharge support and centering flange 36.

To provide stability of the pump support so that it does not tip over when a pump assembly 38 installed within pump housing 16 is turned on, pump support rails 14 are spaced from each other and pump support housing 16 so that the ratio of the distance 40 from the center line 32 to the lower edges 12 of pump support rails 14 is no more than one half the distance 42 between pump support rails 14. In a preferred embodiment wherein pump housing 16 is an 8" diameter tube, distance 40 (the height) is 18" and distance 42 (the width) is 36". We have discovered that when the width to height ratio of the pump support is greater than or equal to two to one, the pump support remains stable and does not tip over upon the application of torque when pump assembly 38 is turned on. This may be stated differently by saying that height 40 is no more than one half the distance 42.

An intake screen 44 is provided at an end 46 of pump housing 16. The intake screen is disposed a distance 48 from the end cap 50 of pump housing 16. Intake screen 44 is located in pump housing 16 so as to provide fluid flow over pump assembly 38 to the intake port 52 in the pump assembly. Intake screen 44 is located so that fluid flowing through pump housing 16 along the direction of arrows 54 sufficiently cools a pump motor mounted in pump assembly 38. Intake screen 44 is disposed a distance 48 so that fluid flowing through intake screen 46 is not blocked by a motor bearing 56 that occupies the entire inner diameter of pump housing 16 in region 48. Intake screen 44 has a fluid flow capacity sufficient to provide a minimum fluid flow velocity determined by a cooling requirement of pump assembly 38, and is additionally sized to have a fluid flow capacity sufficient to provide a maximum fluid flow velocity to reduce vortices in a fluid flowing through pump housing 16 along arrows 54. In a typical embodiment, intake screen 44 is 9" long, distance 48 is 6", and pump housing 16 is an 8" diameter tube. Intake screen 44 may be constructed by drilling ¼" holes ½" on center in pump housing 16. This provides intake screen 44 with a fluid flow rate of approximately 50 to 500 gallons per minute depending upon the capacity of pump assembly 38 installed in the submersible pump support. This configuration of pump housing 16 provides a standard size having a range of flow capacity over which different capacity pump assemblies will operate properly, allowing the user to select the output range desired by selecting an appropriate capacity pump assembly.

Pump assembly 38 is typically installed in the hollow portion 39 of pump housing 16 by sliding the pump assembly along the direction of arrow 41. Split flange support 36 is then typically bolted to flange 34 to hold pump assembly 38 in pump housing 16.

Submersible pump support 10 is constructed of a lighter than water material, that is, a material having a specific gravity of less than one. The use of a lighter than water material allows the pump support to be easily installed and removed from a body of water. In a preferred embodiment, the material is polyethylene (HDPE). This material is inert to most chemicals and is fungus and algae resistant. In addition, it is resilient so that it absorbs surges, vibration, and other stresses that may be applied to it during pump operation. In addition, it does not rust, pit, or corrode. Carbon black may be mixed into the polyethylene (HDPE) material to provide protection from ultraviolet rays that might cause the polyethylene (HDPE) to break down.

Cradles 18, pump support rails 14, and pump housing 16 may be joined together using heat welding techniques known to those skilled in the art wherein polyethylene (HDPE) is used as the welding material. Alternatively, cradles 18 may be bolted to pump housing 16 and pump support rails 14.

Portions 28 and 30 may be attached to pump support rails 14 using heat welding as well. Pump support rails 14 are, in a preferred embodiment, hollow tubes. Additional buoyancy may be provided by sealing the ends 60 of pump support rails 12 to provide enhanced removal capability.

A connector 62 is provided in pump housing 16 to allow electrical connections to pump assembly 38. A threaded or flanged stainless steel discharge nozzle 64 is mounted to split flange pump support 36. A globe-style check valve 66 is mounted to discharge nozzle 64. Fluid pumped by pump assembly 38 exits via piping 68. Piping 68 may also be polyethylene (HDPE).

Typical pump assemblies 38 that may be used in the present invention include Berkeley Submersible Turbine Nos. 6T-125, 6TP-150, 7T40-350, 7T30-350, American Turbine Model No. 6-L-14, and Deming Turbine Model No. 6730-M8E.

Figure 2B:
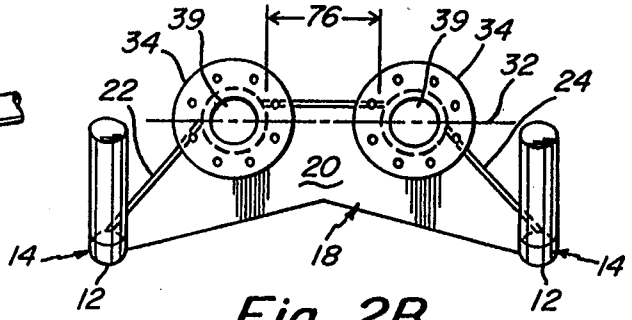
FIGS. 2, 2A, and 2B are respective elevation, plan, and cross-sectional (along line B—B of FIG. 2) views of a duplex submersible pump support in accordance with the present invention.
Figure 2:
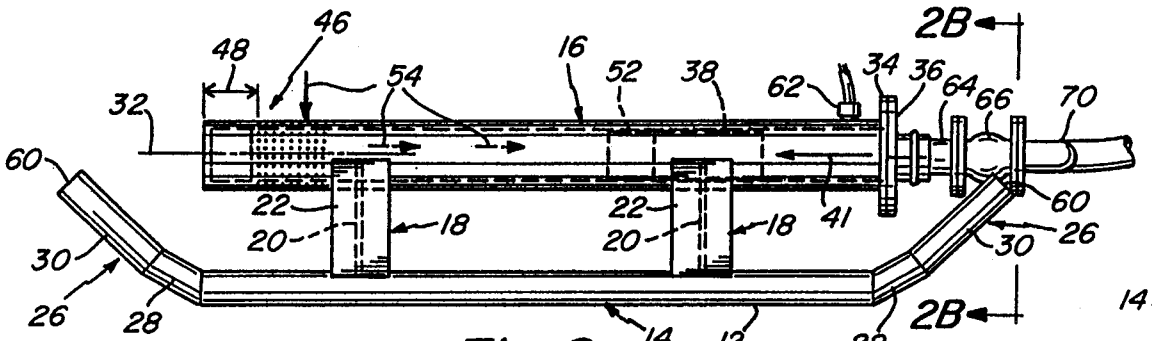
Figure 2A:
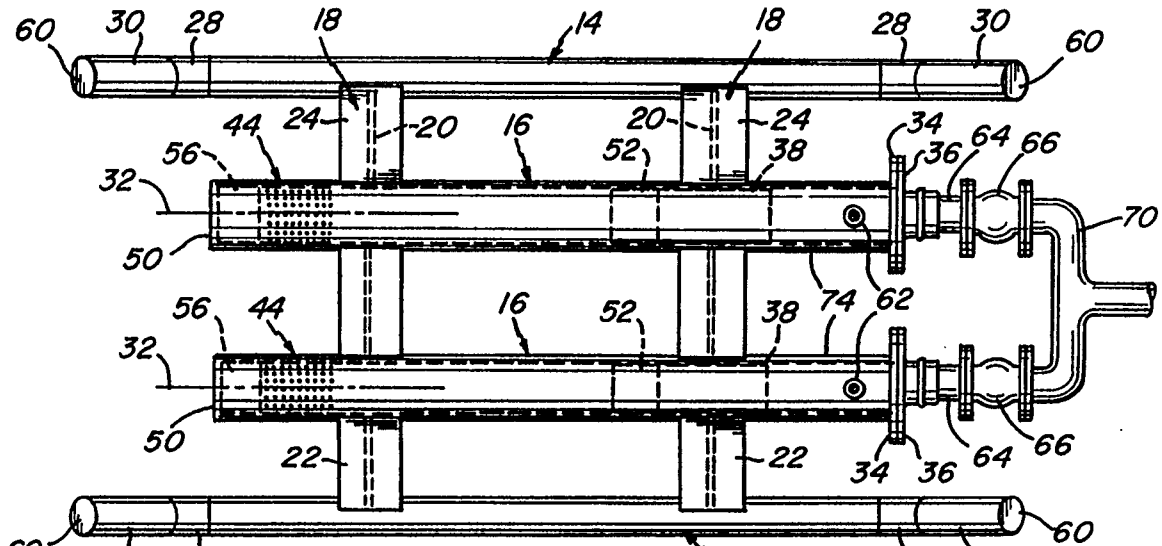

The present invention may be designed using a standard-sized pump housing to provide a base unit of pumping capacity. For example, the 8" pump housing illustrated in FIGS. 1, 1A, and 1B provides an average flow capacity of approximately 250 gallons per minute, though proper operation is obtained over the range of approximately 50 to 500 gallons per minute. The average rate can be varied by the installation of different pump assemblies 38 in pump housing 16 to meet different application requirements in the approximately 50 to 500 gallon per minute range. In addition, the pump support of the present invention can be used to provide multiples of this flow capacity as well. For example, FIGS. 2, 2A, and 2B illustrate a duplex submersible pump support in accordance with the present invention having two pump support housings 16 each having an average flow capacity of 250 gallons per minute and a working range of approximately 50 to 500 gallons per minute. This provides the embodiment of FIGS. 2, 2A, and 2B with a flow capacity of approximately 100 to 1,000 gallons per minute, depending upon the pump assembly installed in each pump housing 16. The pump assemblies installed in each pump housing do not need to be identical. For example, a total capacity of approximately 600 gallons per minute could be provided by using a pump assembly having a capacity of approximately 400 gallons per minute and a second pump assembly having a capacity of approximately 200 gallons per minute.

Figure 3B:
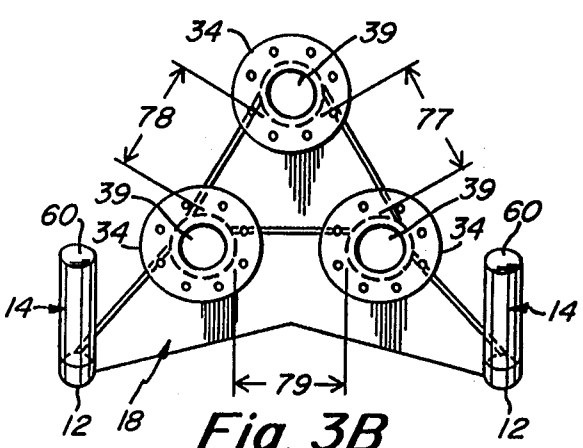
FIGS. 3, 3A, and 3B are respective elevation, plan, and cross-sectional (along line C—C of FIG. 3) views of a triplex submersible pump support in accordance with the present invention.
Figure 3:
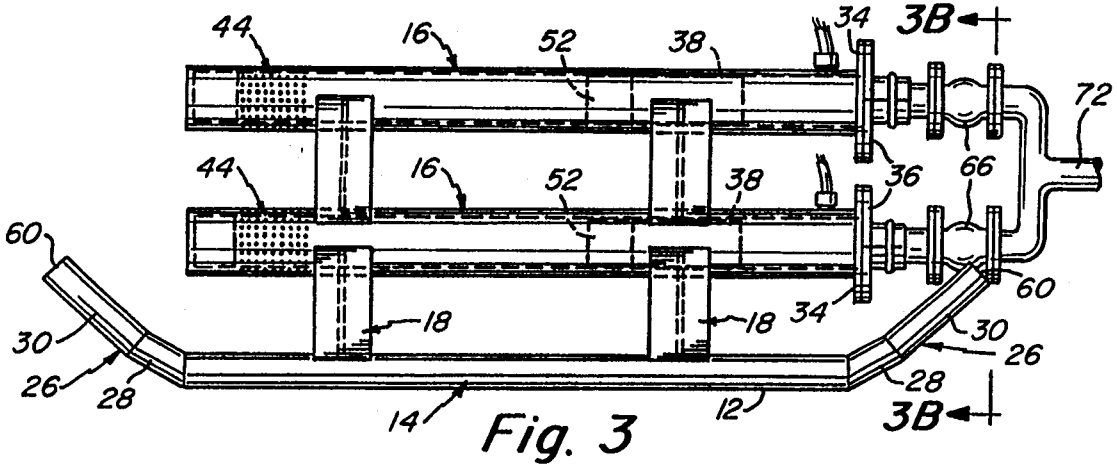
Figure 3A:
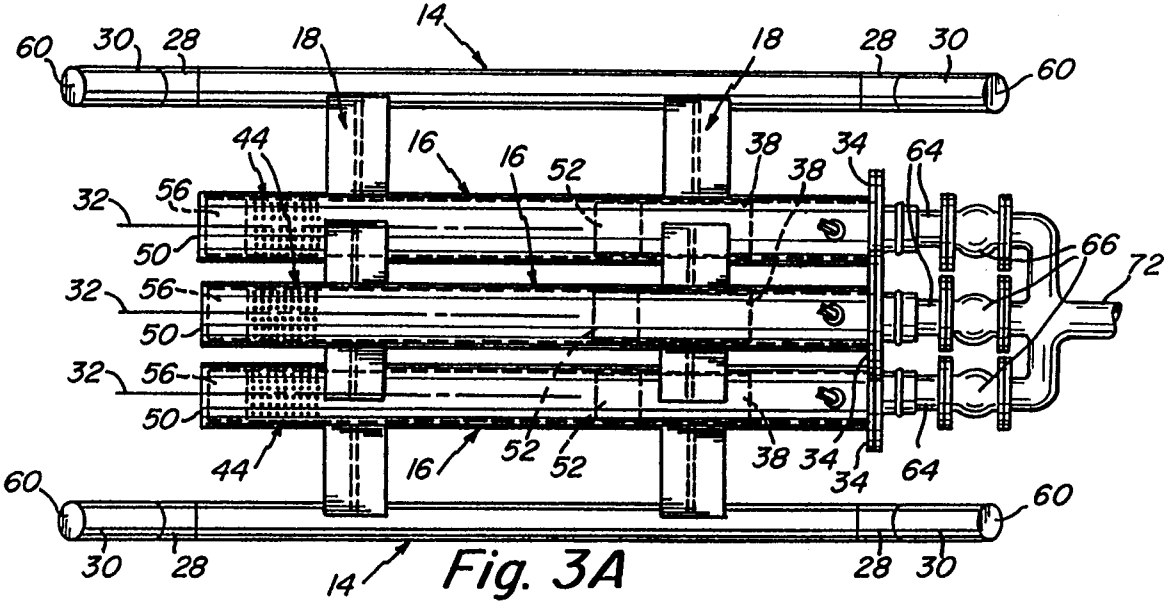

FIG. 3, 3A, and 3B illustrate a triplex design that provides a per housing flow capacity of approximately 250 gallons per minute and an overall flow capacity of approximately 150 to 1,500 gallons per minute depending upon the particular pump assemblies installed in each pump housing 16.

In the embodiments of FIGS. 2, 2A, 2B and 3, 3A, 3B, polyethylene (HDPE) headers 70, 72 respectively are used to combine the fluid output from each pump housing 16. In addition, in the embodiments of FIGS. 2, 2A, 2B and 3, 3A, 3B, we have discovered that in order to prevent vorticing and cavitation between the multiple pump housings caused by operation of multiple pumps in close proximity, the spacing between the outer surface 74 of each pump housing should be a minimum of approximately 10". Thus, in FIG. 2B, distance 76 is at least approximately 10". In FIG. 3B, distances 78, 80, and 82 are at least approximately 10" each respectively. Furthermore, in the embodiments illustrated in FIGS. 2–2B and 3–3B, the same minimum two to one width to height ratio of the pump housings to the pump support rails as discussed in connection with FIGS. 1, 1A, 1B is maintained to provide stability. In addition, the location and the size of intake screen 44 in each pump housing 16 follows the same design considerations as discussed in connection with the embodiment of FIGS. 1, 1A, 1B.

Figure 4:
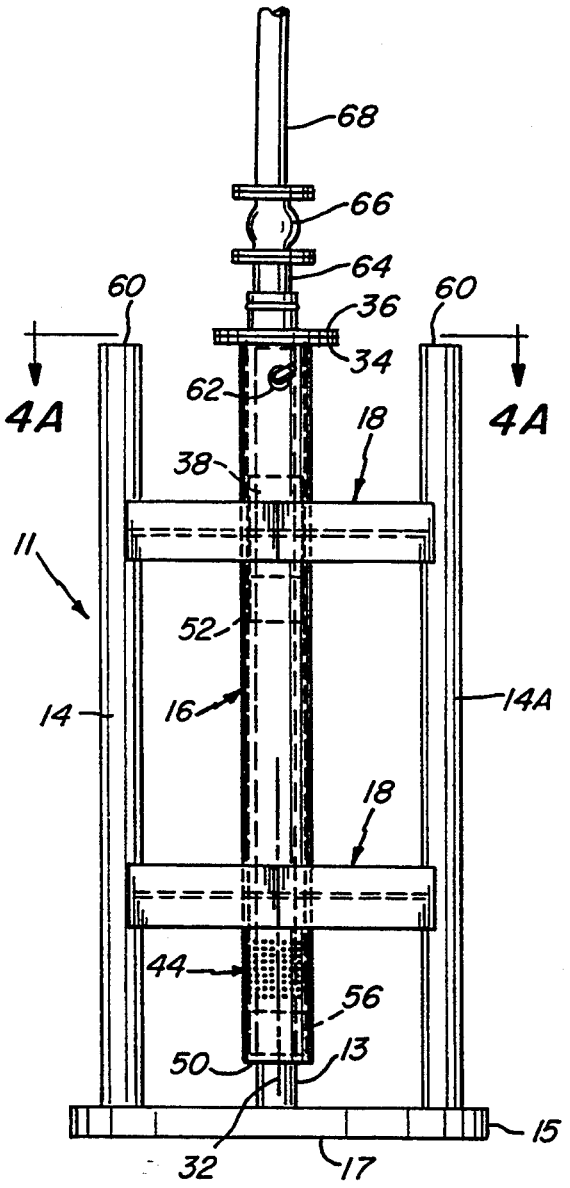
FIGS. 4 and 4A are respective cross-sectional (along line D—D of FIG. 4) and plan views of a vertical pump support in accordance with the present invention.
Figure 4A:
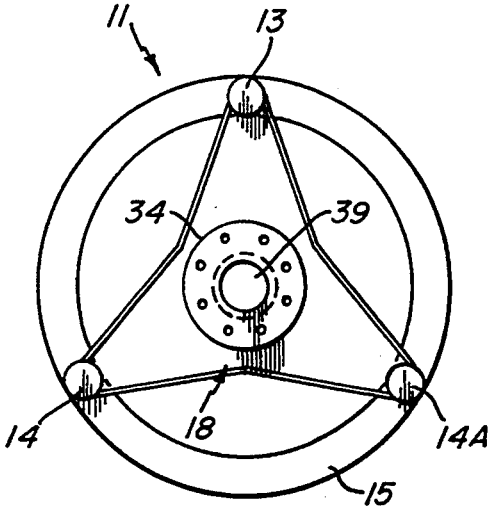

FIG. 4 and 4A illustrates an alternate embodiment of the present invention. FIGS. 4, 4A illustrate a "vertical" submersible pump support 11. The pump support of FIGS. 4, 4A is referred to as vertical because pump housing 16 is substantially perpendicular to a surface on which pump support 11 rests. The pump support 11 is constructed of a material having a specific gravity of less than one, such as polyethylene (HDPE), in the same manner as discussed in connection with FIGS. 1, 1A, 1B. The vertical pump support includes an intake screen 46 that follows the same design considerations as discussed in connection with FIGS. 1, 1A, 1B.

In the embodiment illustrated in FIGS. 4, 4A, a third pump support rail 13 is added to pump support rails 12. A base member 15 is used to couple the ends of pump support rails 14, 14A, 13 together and is preferably annular as illustrated in FIG. 4A. The embodiment of FIGS. 4, 4A is designed to rest on the bottom of a body of water to be pumped on the bottom 17 of base member 15. Pump support rails 14, 14A, 13 may be equally spaced about the circumference of pump support 16. Although three pump support rails have been illustrated, one skilled in the art will appreciate that additional pump support rails may be provided around the circumference of pump housing 16 and that base member 15 can be other configurations besides annular. Pump support rails 14, 14A and 13 do not necessarily follow the two to one width to height ratio discussed in conjunction with the embodiments of FIGS. 1, 1A, 1B, 2, 2A, 2B, and 3, 3A, 3B. Additional buoyancy may be provided by sealing the ends of pump support rails 14, 14A, and 13.

Figure 5A:
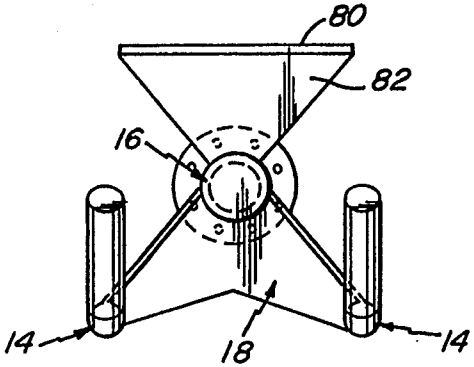
FIGS. 5 and 5A are respective elevation and cross-sectional (along line E—E of FIG. 5) views of an anti-vortex plate in accordance with another aspect of the present invention.
Figure 5:
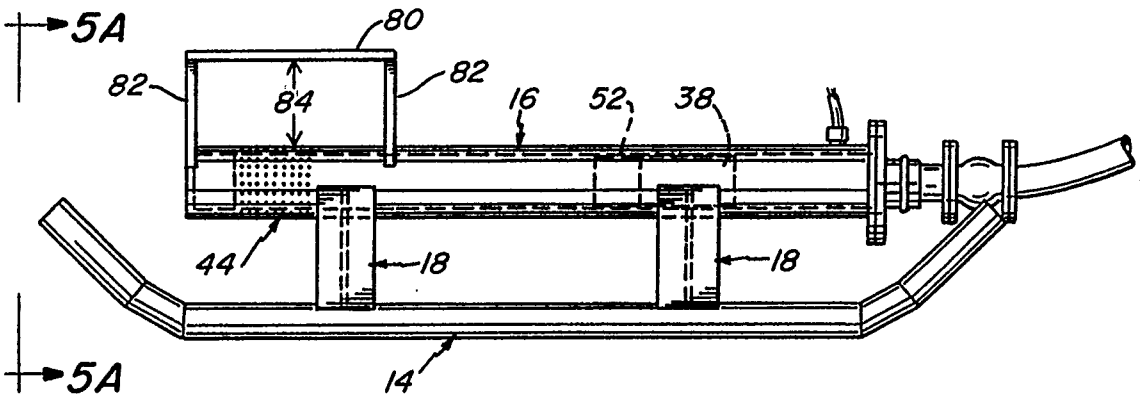

In some cases, such as in low water applications wherein the amount of water above pump support 10 is low enough that upon operation of the pump, air may be sucked in through intake screen 44. To avoid this condition, FIGS. 5, 5A illustrate the addition of an anti-vortex plate 80 disposed above intake screen 44. Plate 80 is supported above pump housing 16 by webs 82. Plate 80 and webs 82 may be constructed out of polyethylene (HDPE) and heat welded together. Webs 82 may be heat welded to pump housing 16. Webs 82 are typically sized so that the distance 84 from anti-vortex plate 80 to intake screen 44 is approximately 10".

Figure 6A:
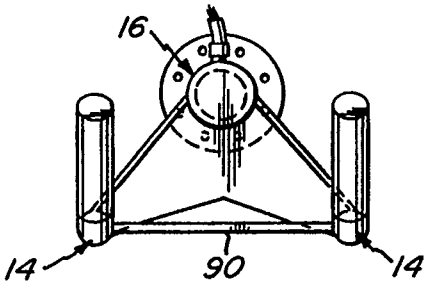
FIGS. 6 and 6A are respective elevation and cross-sectional (along line F—F of FIG. 6) views of an anti-debris plate in accordance with another aspect of the present invention.
Figure 6:
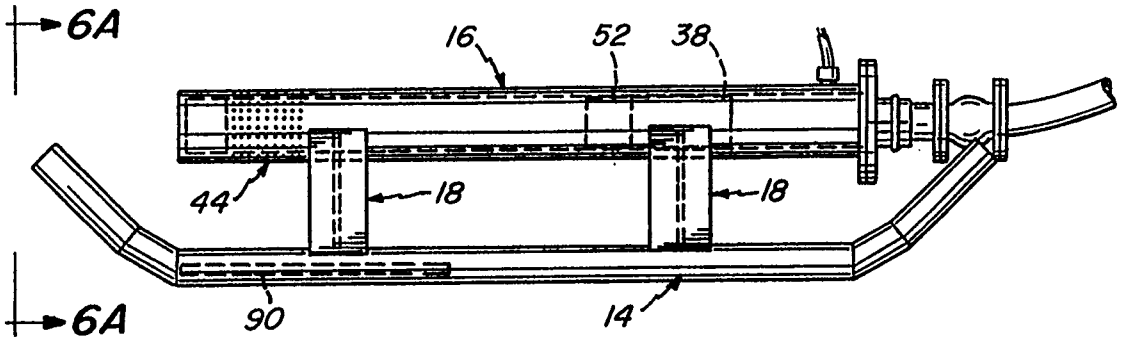

In addition, sometimes the bottom of a body of water will be extremely muddy or loose or contain debris that upon operation of pump assembly 38, causes this debris to clog intake screen 44. In this case, an anti-debris plate, as shown in FIGS. 6, 6A may be mounted between pump support rails 12 in the vicinity of intake screen 44. Anti-debris plate 90 may also be constructed of polyethylene (HDPE) and heat welded to pump support rails 14.

The anti-vortex plate 80 and the anti-debris plate 90 may be used in the embodiments illustrated in FIGS. 1, 1A, 1B, 2, 2A, 2B, 3, 3A, 3B, and 4, 4A.

The dimensions illustrated in the figures are representative of one embodiment of the invention.

Having thus described one particular embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is not intended as limiting. The invention is limited only as defined in the following claims and the equivalents thereto.

What is claimed is:

1. A submersible pump support, comprising:

at least one housing;

a first pump support rail extending in a first direction in a first plane coupled to and supporting the at least one pump housing;

a second pump support rail extending in the first direction in the first plane coupled to and supporting the at least one pump housing;

wherein a distance of the at least one pump housing from the first plane is no more than one half a distance, in the first plane, between the first and second pump support rails;

wherein the first and second pump support rail is coupled to the at least one pump housing by at least one cradle;

wherein the at least one pump housing, the first and second pump support rails, and the at least one cradle comprise a material having a specific gravity of less than one;

wherein the material is polyethylene (HDPE);

further comprising an intake screen disposed in the at least one pump housing including means for providing fluid flow over a pump assembly mounted in the at least one pump housing to an intake port of a pump in the pump assembly; and wherein the intake screen has means for providing a fluid flow capacity sufficient to provide a minimum fluid flow velocity determined by a cooling requirement of a pump assembly mounted in the pump housing.

2. The submersible pump support of claim 1, wherein the intake screen additionally has a fluid flow capacity sufficient to provide a maximum fluid flow velocity to reduce vortices in a fluid flowing through the at least one pump housing.

3. The submersible pump support of claim 2, wherein the at least one pump housing includes two pump housings.

4. The submersible pump support of claim 3, further comprising at least one additional pump housing mounted above the at least one pump housing.

5. The submersible pump support of claim 2, wherein the first and second pump support rails are parallel to each other and the first and second pump support rails each include a first end and a second end, the first end and second end each comprising an angled portion.

6. The submersible pump support of claim 5, wherein the angled portion is disposed at an angle to the pump support rail so that the angled portion extends towards the at least one pump housing.

7. The submersible pump support of claim 6, wherein the first and second pump support rails are hollow tubes.

8. The submersible pump support of claim 7, further comprising means for sealing respective ends of the hollow tubes.

9. The submersible pump support of claim 6, further comprising means for coupling the first and second pump support rails to the at least one cradle and for coupling the at least one pump housing to the at least one cradle.

10. The submersible pump support of claim 9, wherein the means for coupling includes heat welds of polyethylene (HDPE).

11. The submersible pump support of claim 9, further comprising carbon black mixed into the polyethylene (HDPE).

12. The submersible pump support of claim 9, further comprising an anti-debris plate coupled between the first and second pump support rails.

13. The submersible pump support of claim 9, further comprising an anti-vortex plate disposed a predetermined distance from the intake screen and parallel to the at least one pump support housing.

14. The submersible pump support of claim 9, further comprising a pump assembly mounted in the at least one pump housing.

15. A submersible pump support, comprising:

at least one pump housing;

a first pump support rail extending in a first direction in a first plane coupled to and supporting the at least one pump housing;

a second pump support rail extending in a first direction in the first plane coupled to and supporting the at least one pump housing; and an intake screen located in the at least one pump housing including means for providing unobstructed fluid flow over a pump assembly mounted in the at least one pump housing to an intake port of a pump in the pump assembly, the intake screen having means for providing a fluid flow capacity sufficient to provide a minimum fluid flow velocity determined by a cooling requirement of a pump assembly, the intake screen additionally having means for providing a fluid flow capacity sufficient to provide a maximum fluid flow velocity to reduce vortices in a fluid flowing through the at least one pump housing;

wherein the at least one pump housing and the first and second pump support rails comprise a material having a specific gravity of less than 1.

16. The submersible pump support of claim 15, wherein the material is polyethylene (HDPE).

17. A submersible pump support, comprising:

at least one pump housing;

at first pump support rail extending in a first direction in a first plane coupled to and supporting the at least one pump housing;

a second pump support rail extending in a first direction in the first plane coupled to and supporting the at least one pump housing;

an intake screen located in the at least one pump housing so as to provide fluid flow over a pump assembly mounted in the at least one pump housing to an intake port of a pump in the pump assembly, the intake screen being located in the at least one pump housing and having a fluid flow capacity sufficient to provide a minimum fluid flow velocity determined by a cooling requirement of a pump assembly, the intake screen additionally having a fluid flow capacity sufficient to provide a maximum fluid flow velocity to reduce vortices in a fluid flowing through the at least one pump housing; and a third pump support rail extending in the first direction in a second plane, coupled to and supporting the at least one pump housing, wherein the second pump support rail additionally extends in the first direction in the second plane;

wherein the at least one pump housing, the first pump support rail, the second pump support rail, and the third pump support rail comprise a material having a specific gravity of less than 1.

18. The submersible pump support of claim 17, wherein the at least one pump housing and the first, second, and third pump support rails comprise a material having a specific gravity of less than 1.

19. The submersible pump support of claim 18, wherein the material is polyethylene (HDPE).

* * * * *